US010093479B2

(12) United States Patent
Fuchs et al.

(10) Patent No.: US 10,093,479 B2
(45) Date of Patent: Oct. 9, 2018

(54) DISPENSER CARTRIDGE AND DISPENSER ARRANGEMENT

(71) Applicant: NUAPUA GMBH, Kremsmünster (AT)

(72) Inventors: Gerhard Fuchs, Prutz/Kauns (AT); Hermann Bürtlmair, Kremsmünster (AT)

(73) Assignee: NUAPUA GmbH, Kremsmünster (AT)

( * ) Notice: Subject to any disclaimer, the term of this patent is extended or adjusted under 35 U.S.C. 154(b) by 69 days.

(21) Appl. No.: 14/901,276

(22) PCT Filed: Jun. 24, 2014

(86) PCT No.: PCT/AT2014/050140

§ 371 (c)(1),
(2) Date: Dec. 28, 2015

(87) PCT Pub. No.: WO2014/205469

PCT Pub. Date: Dec. 31, 2014

(65) Prior Publication Data

US 2016/0152408 A1 Jun. 2, 2016

(30) Foreign Application Priority Data

Jun. 25, 2013 (AT) ..... A 50415/2013

(51) Int. Cl.
*B65D 85/804* (2006.01)
*B65D 51/28* (2006.01)
(Continued)

(52) U.S. Cl.
CPC ..... *B65D 85/8043* (2013.01); *B65D 47/242* (2013.01); *B65D 47/265* (2013.01);
(Continued)

(58) Field of Classification Search
CPC .. B65D 25/005; B65D 47/242; B65D 47/265; B65D 51/2864; B65D 81/3216;
(Continued)

(56) References Cited

U.S. PATENT DOCUMENTS 3,463,361 A 8/1969 Cook et al.
8,083,056 B1 * 12/2011 Wu ..... B65D 25/08 206/221

(Continued)

FOREIGN PATENT DOCUMENTS

EP 1 059 852 12/2000
JP H05 16975 1/1993

OTHER PUBLICATIONS

International Search Report issued by the European Patent Office in International Application PCT/AT2014/050140.

*Primary Examiner* — Drew E Becker
*Assistant Examiner* — Bryan Kim
(74) *Attorney, Agent, or Firm* — Henry M Feiereisen LLC

(57) ABSTRACT

A dispenser cartridge for use in a dispenser arrangement for introducing at least one dispensed substance into a liquid, includes an enveloping element with a continuous central space and with at least two openings for the entry and exit of the liquid respectively, wherein the dispensed substance is provided in the central space wherein first and second sealing means are provided which seal the openings completely in an initial configuration, wherein the sealing means can be brought into an operating configuration in which a flow path through the enveloping element is opened for the liquid.

17 Claims, 9 Drawing Sheets

(51) Int. Cl.
*B65D 47/24* (2006.01)
*B65D 47/26* (2006.01)
*B65D 85/808* (2006.01)
*B01F 13/00* (2006.01)

(52) U.S. Cl.
CPC ..... *B65D 51/2807* (2013.01); *B65D 51/2864* (2013.01); *B65D 51/2892* (2013.01); *B65D 85/808* (2013.01); *B01F 13/002* (2013.01)

(58) Field of Classification Search
CPC ..... B65D 81/3222; B65D 18/3227; B65D 81/325; B65D 81/3255; B65D 85/804; B65D 85/8043; B65D 85/808; B65D 51/00; B65D 51/28; B65D 51/2807; B65D 51/2814; B65D 51/2857; B65D 51/2892; B65D 51/2878; A47J 31/0636; A47J 31/20; B01F 13/0016; B01F 13/0018; B01F 13/002; B01F 13/0022
See application file for complete search history.

(56) References Cited

U.S. PATENT DOCUMENTS 8,839,982 B1* 9/2014 Anderson ..... B65D 51/2835 206/222
9,617,051 B2* 4/2017 Lee ..... B65D 51/2857
2001/0013523 A1* 8/2001 Gross ..... B65D 47/2031 222/94
2003/0072850 A1* 4/2003 Burniski ..... B65D 47/243 426/115
2004/0076074 A1 4/2004 Shubeck
2007/0163985 A1* 7/2007 Morini ..... B65D 51/2814 215/202
2008/0073307 A1* 3/2008 Sweeney ..... B65D 51/2864 215/228
2010/0000960 A1* 1/2010 Anderson ..... B65D 51/2807 215/228
2010/0044338 A1* 2/2010 Smith ..... B65D 47/2018 215/316
2010/0108715 A1* 5/2010 Santagiuliana .... B65D 51/2835 222/81
2010/0154644 A1 6/2010 Skalski et al.
2010/0187142 A1 7/2010 Lee et al.
2010/0276308 A1* 11/2010 Lee ..... B65D 51/2864 206/219
2011/0278184 A1* 11/2011 Middleman ..... A47G 21/00 206/222
2012/0055942 A1* 3/2012 Claessens ..... A47G 21/18 220/705
2012/0217178 A1* 8/2012 Rohr ..... B65D 41/04 206/219
2012/0223100 A1* 9/2012 Simonian ..... B65D 51/2892 222/145.1
2012/0305519 A1* 12/2012 Lee ..... B65D 51/2835 215/316
2013/0082022 A1* 4/2013 Cronin ..... B65D 51/2864 215/228
2013/0119087 A1* 5/2013 Owoc ..... B65D 23/00 222/129
2013/0129870 A1* 5/2013 Novak ..... B65D 85/73 426/115
2014/0092703 A1* 4/2014 Helou, Jr. ..... B01F 13/0022 366/130
2014/0144864 A1* 5/2014 Lee ..... B65D 51/28 215/6
2014/0251938 A1* 9/2014 Rose ..... B65D 51/28 215/6
2014/0263154 A1* 9/2014 Musumeci, Jr. ... B65D 51/2892 215/250
2014/0312065 A1* 10/2014 Rohr ..... B65D 81/3211 222/129
2015/0034673 A1* 2/2015 Hopkins ..... B65D 47/243 222/129
2015/0239638 A1* 8/2015 Lee ..... B65D 51/285 206/222
2015/0289708 A1* 10/2015 Ezaz-Nikpay ..... A47J 31/407 426/115
2015/0336722 A1* 11/2015 Brook-Chrispin ..... B65D 51/28 215/228
2015/0336724 A1* 11/2015 Simonian ..... B65D 51/2892 222/546

* cited by examiner

Section XI

Section XII

Section XIII

Section XIV

DISPENSER CARTRIDGE AND DISPENSER ARRANGEMENT

CROSS-REFERENCES TO RELATED APPLICATIONS

This application is the U.S. National Stage of International Application No. PCT/AT2014/050140, filed Jun. 24, 2014, which designated the United States and has been published as International Publication No. WO 2014/205469 and which claims the priority of Austrian Patent Application, Serial No. A 50415/2013, filed Jun. 25, 2013, pursuant to 35 U.S.C. 119(a)-(d).

BACKGROUND OF THE INVENTION

The present invention relates to a dispenser cartridge and a dispenser arrangement into which such dispenser cartridges can be inserted.

From the state of the art various methods and devices are known to introduce different substances, for example flavoring agents or dyes, into beverages or to flavor beverages, color beverages or to mix beverages with various substances. A very simple method is to mix the substance directly into the base liquid, which however, creates an irreversible state and the amount of the introduced substance, once fixed, cannot be changed. Another system is known, for example from U.S. Pat. No. 3,463,361, in which a flavoring agent is contained in a type of straw and the flavor is given off to a liquid when the liquid is drawn through the straw. Further systems are for example known from EP 1 059 852, in which hollow cylindrical matrix bodies and substances integrated in the matrix bodies are for example inserted into a bottle attachment so that the liquid is forced to flow past the bottle attachment and takes up the flavors. Although in these systems the original liquid is not flavored, the entire amount of liquid which flows from the source to the user is necessarily always mixed with the substance and there is no possibility to vary or avoid this circumstance.

Also known from the state-of-the-art are cartridges for insertion into such devices, in which the substance or the flavor agent is contained. During operation the cartridge is opened once and irreversibly and then discharges the entire amount of the substance into the liquid. This is disadvantageous because in this way the cartridge can only be used once and also the degree to which the substance is added cannot be adjusted.

SUMMARY OF THE INVENTION

Therefore it is an object of the present invention to provide a dispenser cartridge of the aforementioned type, which can be stored well and at the same time enables a controllable and adjustable release of the dispenser substance that is to be added.

This object is solved by the characterizing features of the independent claim claiming the dispenser cartridge. It is provided that first and second closure means are provided, which in a starting configuration tightly close the openings, wherein the closure means can be caused to assume an operating configuration in which a flow passage for the liquid through the sleeve element is released. As a result of the tight closure of the openings, the dispenser substance is durably stored in the interior of the dispenser cartridge and is in particular protected against external environmental influences. At the same time, providing a defined flow passage through the dispenser cartridge also ensures that the stream of liquid, which enters the dispenser cartridge, takes up the dispenser substance and exits the dispenser cartridge, can be adjusted and thus the design of the dispenser cartridge enables controlling when and how much of the dispenser substance enters the liquid.

Particularly advantageous embodiments of the dispenser cartridge are defined in more detail by the features of the dependent claims: Thus an optimal protection of the dispenser substance is ensured in that in the starting configuration the dispenser cartridge is closed fluid and/or gas tight against an unintended entry of the liquid, and is closed fluid and/or gas tight against a release of the dispenser substance. An easy to manufacture dispenser cartridge with good flow characteristics, which can be stored space-effectively results in that the dispenser cartridge or the sleeve element has a tubular, in particular hollow cylindrical, longitudinal shape, which is rotation symmetric about its central longitudinal axis, or in that that the dispenser cartridge or the sleeve element is configured as a, in particular straight, hollow cylinder with a triangular cross-section, preferably as isosceles triangle with outwardly curved legs or as a polygonal profile.

The features that the sleeve element has a waved or serrated or curved wall, wherein the inner surface, and optionally also the outer surface of the sleeve element, has a waved or serrated configuration which deviates from a circular cylindrical sheath surface, ensures permanently good flow characteristics through the dispenser cartridge, because this results in channels for the liquid passage always remaining at least in the border region. In addition this shape prevents that the dispenser cartridge can be rotated when it is inserted into a seat with corresponding shape in a dispenser arrangement.

According to a particularly preferred embodiment the closure means are adjustable, which allows adjusting, in particularly continuously, the entry of the liquid into, flow through and exit from the central space or the dispenser cartridge. This allows controlling entry and exit of the liquid from the dispenser cartridge not only by selecting the amount of liquid flowing through the dispenser cartridge but also by constructive means contained in the dispenser cartridge itself, thereby correspondingly adjusting impingement of the liquid with the dispenser substance. The closure means are advantageously configured so as to be adjustable by a externally actuatable activating or actuating means. It is particularly advantageous in this connection when the closure means are adjustable reversibly in both directions i.e., in opposite directions relative to each other, and can be displaced, in particular linearly, along the longitudinal or central axis. This allows increasing and also decreasing the flow through the dispenser cartridge.

It is advantageous when after the first opening the flow-through passage or the flow rate through the central space or through the dispenser cartridge can be reduced by the closure means by at least 50%, preferably 70%, particularly preferably by 90% relative to the maximal flow through capacity, or that the openings can be completely sealed again by closure means after the initial opening.

In a constructively advantageous configuration the first and second closure means are configured as plugs or include plugs. In this context it is particularly preferred when a respective guide element is arranged in the openings, in particular inserted to the most part or completely into the interior of the central space, wherein the plug is in each case supported or arranged in a central continuous recess of the guide element.

In order to ensure a reliable adjustment of the flow through the dispenser cartridge it is advantageous when actuating guides, in particular recesses, are formed on the outsides of the plugs, which outsides face away from the central space, which actuating guides can be caused to mechanically interact with external activating or actuating elements or can be force-fittingly and/or form fittingly inserted into the external activating or actuating means. This also ensures the reversible adjustability of the plugs.

According to a further advantageous embodiment, the plugs are always arranged in the interior of the dispenser cartridge or in the interior of the central space, both in the starting configuration as well as the operating configuration. The plugs are thus components of the dispenser cartridge, which neither prior to nor during nor after use of the dispenser cartridge accrue separately or fall out, but remain permanently in the interior of the dispenser cartridge.

Regarding the dispenser substance itself it is advantageous when the dispenser substance is present in a form in which it at least partially enters the liquid when contacting the liquid. This ensures a reliable dosing. In this connection it is advantageous when the at least one dispenser substance is soluble in the liquid or dispersible in the liquid and is selected from the group consisting of flavor agents, drugs, additives, vitamins, and/or dyes etc. However other substances which can be introduced in this way into the liquid can also be used.

One possibility of arranging the dispenser substance is to apply or arrange the dispenser substance on the inner surface of the sleeve element. However, it is particularly advantageous when the dispenser substance is applied to or contained in at least one separate dispenser element, which is arranged in the central space and is in particular spherical, rod-shaped, thread-shaped or pin-shaped. This also enables that the dispenser substance or the dispenser element can be reversibly exchanged or can be removed after use from the dispenser cartridge and a new dispenser element can be inserted instead.

A dispenser element in which the dispenser substance has a particularly good release profile results when the dispenser element has a porous matrix, in particular made of plastic, which defines an inner network of channels and pores on the exposed surface of the matrix, which are in fluid communication with the channels, wherein the pores preferably have a size of 20 μm to 200 μm, wherein the dispenser substance is located in the matrix, in particular in the channels. Such an element is described in EP 1 059 852 B1. Paragraphs [0061] to [0076] of EP 1 059 852 B1 are hereby incorporated by reference into the present application.

Regarding the functionality it is advantageous when an intermediate region, through which the liquid can permanently flow, is formed between the outer surface of the dispenser element and the inner surface of the sleeve element, with at least portions of the intermediate region remaining constantly free, so that at least one permanently open flow-through channel is established between the two openings. This is for example supported by the particular shape, i.e., the waived or serrated shape, of the wall of the sleeve element. This prevents blockage of the passageway and ensures that the dispenser substance can always be supplied to the liquid.

According to a further aspect of the invention, a dispenser arrangement for introducing a dispenser substance into the liquid is provided, including a dispenser cartridge as described above and a dispenser attachment, which can be connected with a liquid source or a container for receiving and storing liquids, in particular a bottle, wherein the dispenser cartridge is operably connected in or on the dispenser attachment or is brought in operative connection with the dispenser attachment.

It is a further object of the invention to provide a dispenser arrangement with which a controlled and adjustable dosing of the amount of the dispenser substance added to the liquid is possible in a simple manner. This object is solved by the features of claim 21. Hereby a dispenser arrangement for introducing a dispenser substance into a liquid is provided, including

- a dispenser attachment which can be connected with a liquid source or a container for receiving and storing liquids, in particular a bottle, and through which at least part of the liquid can flow, wherein the liquid can be conducted to at least one dispensing opening,
- a dispenser cartridge which contains a dispenser substance, wherein the dispenser cartridge is operably arranged in or on the dispenser attachment or can be operatively connected with the dispenser attachment,
- wherein in the dispenser arrangement a defined main flow passage for the liquid can be formed, which extends in the direction to the dispensing opening so as to avoid or bypass the dispenser cartridge, and
- a defined bypass passage fluidly separated from the main flow passage can be formed, which extends through the dispenser cartridge in the direction towards the dispensing opening so as to contact the dispenser substance and to take up a portion of the dispenser substance.

The constructive separation into a main flow passage and a bypass passage through the dispenser cartridge ensures that not the entire amount of the liquid is mixed with the dispenser substance or is conducted through a element that contains the dispenser substance, but rather the user can adjust the flow conditions, thus rendering the dosing of the dispenser substance flexible over wide ranges. This also ensures that the dispenser substance is mixed into the liquid only immediately prior to use or prior to exiting from the arrangement and thus the mixture always remains fresh. In this way possible interactions or reactions of the dispenser substance with the liquid are reduced or entirely avoided and the user can enjoy a completely freshly prepared mixture with each sip.

According to a particularly advantageous embodiment of the dispenser arrangement the predominant portion of the liquid can flow via the main flow passage or the ratio between the amounts of liquid that flow through the main flow passage and the bypass passage is at least 1:1, preferably 5:1, particularly preferably 9:1. In this way the dispenser cartridge can be kept small and a small amount of liquid, which is permitted to flow through the passage, is sufficient to impinge the liquid with the dispenser substance.

It is further advantageous when the main flow passage and the bypass passage can be fluidly connected or meet before the dispensing opening, and the liquid proportion of the main flow passage can be combined and mixed with the liquid proportion of the bypass passage. This ensures that only already well-mixed liquid with uniformly distributed dispenser substance exits the dispensing opening. This avoids fluctuations and the concentration of the dispenser substance remains constant and is reliably adjustable.

In this connection it is constructively particularly advantageous when a mixing chamber can be or is formed in the dispenser attachment, which mixing chamber is arranged downstream of the dispensing opening and upstream of the dispenser cartridge, and into which mixing chamber the main flow passage and the bypass passage lead. In this way a defined space is formed in which the two flow passages necessarily unite and have to mix prior to reaching the dispensing opening. This ensures optimal homogenization.

A constructively advantageous arrangement results in that the main flow passage is arranged spatially outside around the bypass passage, and surrounds at least sections, in particular all sides, of the bypass passage, in particular the form of multiple separate channels or in the form of an essentially ring-shaped or cylinder-sheath-shaped channel. This configuration also ensures a good mixing efficiency in the mixing chamber.

For reliably opening and adjusting the flow through it is advantageously provided that the dispenser attachment includes activating or actuating means that act on the closure means, in particular on the plugs, by which the opening of the dispenser cartridge and/or the adjustment of the flow-through amount through the bypass passage can be effected.

In a constructively particularly practice-oriented dispenser arrangement, the dispenser attachment includes a base unit and an activating unit, which can be adjusted relative to the base unit, wherein in the base unit as well as in the activating unit mechanical activating or actuating means for acting on the closure means and for opening the dispenser cartridge and with this opening the bypass passage are provided. Such a device can also be operated easily and simply.

In this context it is particularly advantageous when a first seat for the dispenser cartridge is formed in the base unit, wherein at the end region of the first seat which is distal to the dispensing opening, a first activating or actuating means for opening the first plug of the dispenser cartridge, in particular a short first bolt, is arranged, and that a second seat for the opposite end of the dispenser cartridge is formed in the activating unit, wherein at the end region of the second seat which is proximate to the dispensing opening, a second activating or actuating means for opening the second plug, in particular a short second bolt, is arranged. This makes it possible that the dispenser cartridge can be easily and quickly inserted into the dispenser arrangement, where it assumes a safe and central position that is protected from all sides.

The first seat is hereby advantageously configured so that it includes a hollow cylindrical part, which during operation extends along the longitudinal axis downwards towards the liquid source. The inner surface of the first seat or the hollow cylindrical part is configured mirror symmetrical or so as to correspond to the outer shape of the sleeve element, in particular waved or serrated, which secures the dispenser cartridge against rotation in the first seat. The inner surface of the second seat is preferably smooth, in particular circular cylindrical, which allows rotation of the dispenser cartridge in the second seat and thus a rotation of the activating unit relative to the base unit when the dispenser cartridge is inserted.

For reliable activation of the dispenser cartridge and opening of the bypass passage it is advantageously provided that the base unit and the activating unit are supported so that their relative distance to each other can be changed, in particular so as to be rotatable via a threading, which allows adjustment of the linear distance between the first activating or actuating means relative and the second activating or actuating means, wherein a decrease of the distance causes the plugs to be pushed into the interior of the dispenser cartridge.

A reliable changeability and adjustability results advantageously in that the plugs can be moved or displaced respectively by the same distance toward each other. Constructively it is advantageous in this context when the bolts are dimensioned so that they force-fittingly and/or form-fittingly engage into the recesses of the plugs, which also results in a good reversible adjustability.

In this connection it is also advantageous when an increase of the linear distance of the first activating or actuating means relative to the second activating or actuating means can cause a movement of the closure means or the plugs in the direction of their original position, in particular the flow capacity of the dispenser cartridge can be reduced by at least 50%, preferably by 70%, particularly preferably by 90% relative to the maximal flow capacity, preferably an almost completely fluid tight closure of the dispenser cartridge. In order to avoid overturning and to define a maximal lower and upper limit, it is possible that a stop for limiting the maximum movement of the base unit, relative to the activating unit is formed.

A particular advantage for the user is that the dispenser cartridge is reversibly exchangeably insertable into the dispensing arrangement. When the dispensing attachment, in particular the base unit, has a threading, in particular an inner threading, and can be screwed, in particular reversibly, onto a bottle, the dispenser arrangement can in this way be reversibly screwed for example onto conventional beverage bottles, for example PET mineral water bottles, or the bottle and the liquids contained therein can be exchanged at any time.

In order to avoid undesired leakage of the liquid, it is advantageous when a closure unit is provided which is supported so as to be in particular reversibly adjustable relative to the activating unit, by which the bypass passage and optionally also the main flow passage can be closed. On one hand it is possible to block both flow passages, alternatively it can also be advantageous to only configure the bypass passage closable and to keep the main flow passage permanently open, in order to ensure the flow of liquid which is not enriched with the dispenser substance. The closure of unit can also be configured so that the mixing chamber is formed by lifting the closing unit from the activating unit.

BRIEF DESCRIPTION OF THE DRAWING

Further advantages and embodiments of the invention will become apparent from the description and the included drawings.

In the following the invention is schematically illustrated by way of particularly advantageous, but not limiting exemplary embodiments, and is explained exemplarily with reference to the drawings.

DETAILED DESCRIPTION OF PREFERRED EMBODIMENTS

Figure 1:
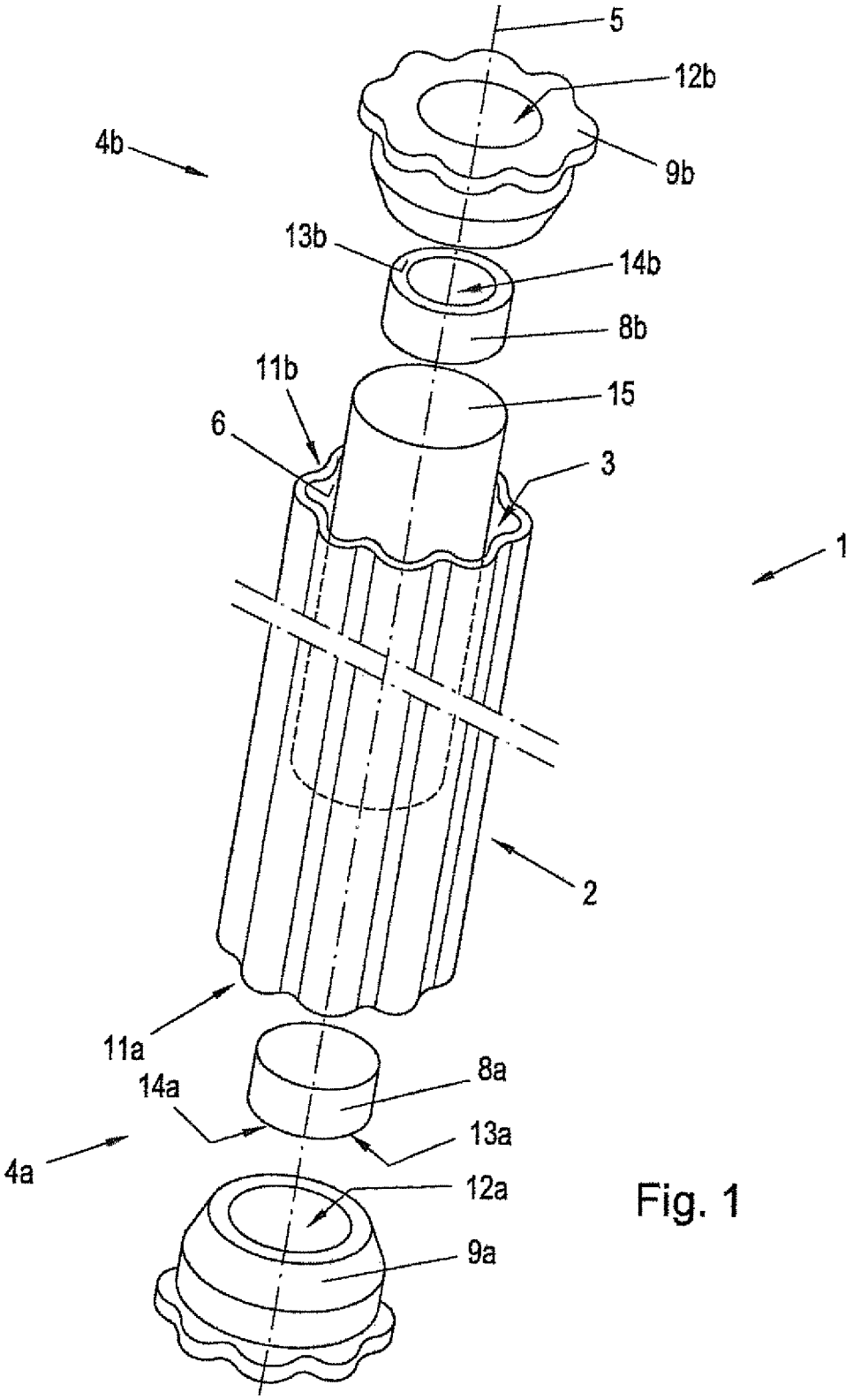
FIG. 1 shows a dispenser cartridge according to the invention in an exploded view.

FIG. 1 shows a dispenser cartridge 1 according to the invention in an exploded view. The dispenser cartridge 1 includes a tubular sleeve element 2 with a continuous central space 3 and with two openings 11*a*, 11*b* provided at the opposing sides of the sleeve element 2. In this way the liquid can enter into the central space 3 through the first opening 11*a*, completely flow through the central space 3 and exit out of the sleeve element 2 on the opposite side through the second opening 11*b*. The sleeve element 2 has a longitudinal configuration and is arranged rotation symmetric about the central longitudinal axis 5. It has approximately the shape of a hollow cylinder, however with waved walls. The wall thickness is small relative to the length, however, it is sufficient to provide the sleeve element 2 with an integral stability. The sleeve element 2 is preferably made from a translucent plastic material.

In the central space 3 a dispenser substance is provided, which when coming into contact with the liquid, can at least partially enter the liquid. This dispenser substance ideally is soluble or dispersible in the liquid. Dispenser substances include flavoring agents, drugs, various additives, vitamins, minerals, dyes or other substances that one may want introduce into the liquid.

The dispenser substance can be arranged in the central space 3 in different ways. In the present case of FIG. 1, the dispenser substance is arranged on a separate rod-shaped dispenser element 15. This dispenser element 15 has a porous matrix made of a polymer material with an internal network of channels and pores on its surface, wherein the dispenser substance is incorporated in this matrix. When coming into contact with the liquid, small amounts of dispenser substance re then washed out and enter the liquid.

Figure 5:
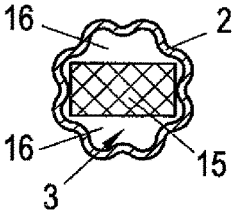
FIGS. 5, 6, 7 and 7*a* show different embodiments of dispenser cartridges.
Figure 6:
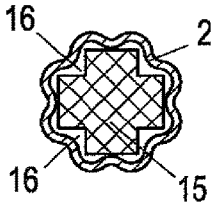
Figure 7:
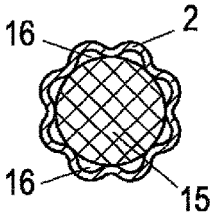

As can be seen in FIGS. 5, 6 and 7 the dispensing element 15 can have different shapes and cross-sections. In FIG. 5 it has the shape of a square, and FIG. 5 it has a cross-shaped cross-section and in FIG. 7 a cylindrical shape. The dispenser element is an integral component of the dispenser cartridge and cannot be removed from the dispenser cartridge.

Between the outer surface of the dispenser element 15 and the inner surface 6 of the sleeve element 2 an intermediate region, which is permanently open and permanently permits flow remains, through which the liquid can flow. In FIGS. 5, 6 and 7 these intermediates regions are indicated as flow-through channels 16. In the embodiment of FIG. 7, the cylindrical dispenser element 15 forms an almost sealing closure with the radially innermost wall parts of the sleeve element 2, however, the flow-through channels 16 formed by the waved configuration remain permanently free. In this way the liquid can permanently flow through of the dispenser cartridge 1 and effectively take up and entrain the dispenser substance.

Figure 7A:
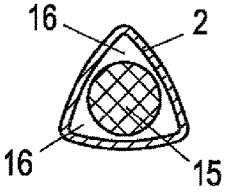

FIG. 7*a* shows an alternative embodiment of the dispenser cartridge 1 in, a cross-section. The sleeve element 2 or the dispenser cartridge 1 is configured as a straight hollow cylinder and has a triangular outer contour and an also triangular inner contour. The corners of the sleeve element 2, which is configured as isosceles triangle, are rounded and the legs of the sleeve element 2 shown in cross-section or the side surfaces or the walls of the dispenser cartridge 1 are outwardly curved.

As an alternative the sleeve element 2 or dispenser cartridge 1 can also be configured triangular, preferably as isosceles triangle, or the dispenser cartridge can be configured in the form of a hollow polygonal profile according to DIN 32711 (P3G) and DIN 32712 (P4C).

The openings 11*a* and 11*b* are closed or closable by first and second closure means 4*a* and 4*b*. In the present embodiment the closure means 4*a*, 4*b* respectively include a guide element 9*a*, 9*b* and a plug 8*a*, 8*b*. The guide element 9*a*, 9*b* is hereby inserted into the corresponding opening 11*a*, 11*b* and arranged lowered into the interior of the central space 3. Each guide element 9*a*, 9*b* has a central recess 12*a*, 12*b*, which completely traverses the guide element 9*a*, 9*b*. In this recess 12*a*, 12*b* the plug 8*a*, 8*b* is inserted, i.e., so that the plug 8*a*, 8*b* ends flush with the respective bottom side of the guide element 9*a*, 9*b*.

Figure 3:
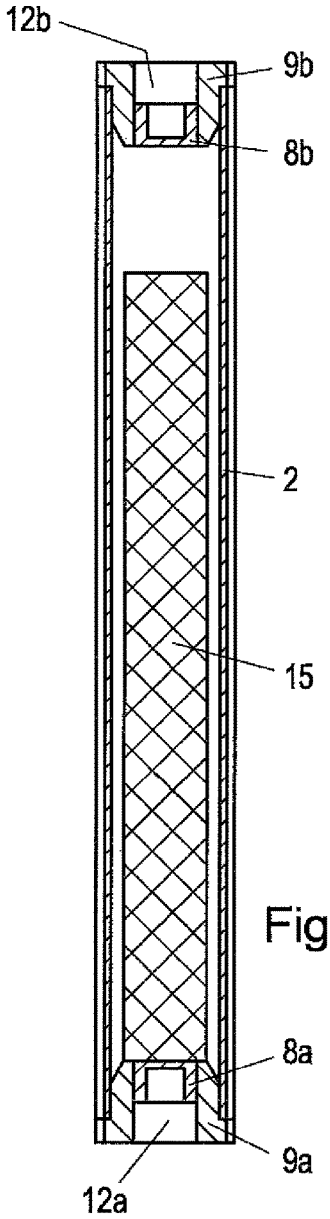
FIG. 3 shows a dispenser cartridge in a sectional view in a closed starting configuration.

FIG. 3 shows the dispenser cartridge 1 in its closed starting configuration in which the plug 8*a*, 8*b* is inserted in the central recesses 12*a*, 12*b* of the guide elements 9*a*, 9*b* and with this represent a fluid-tight and gas-tight barrier and thereby effectively prevents entry of liquid into the central space 3 as well as exit of the dispensers substance out of the dispenser cartridge 1. In this configuration the dispenser cartridges 1 are sold and can be stored over a long period of time because the dispenser substance is well protected against environmental influences.

Figure 4:
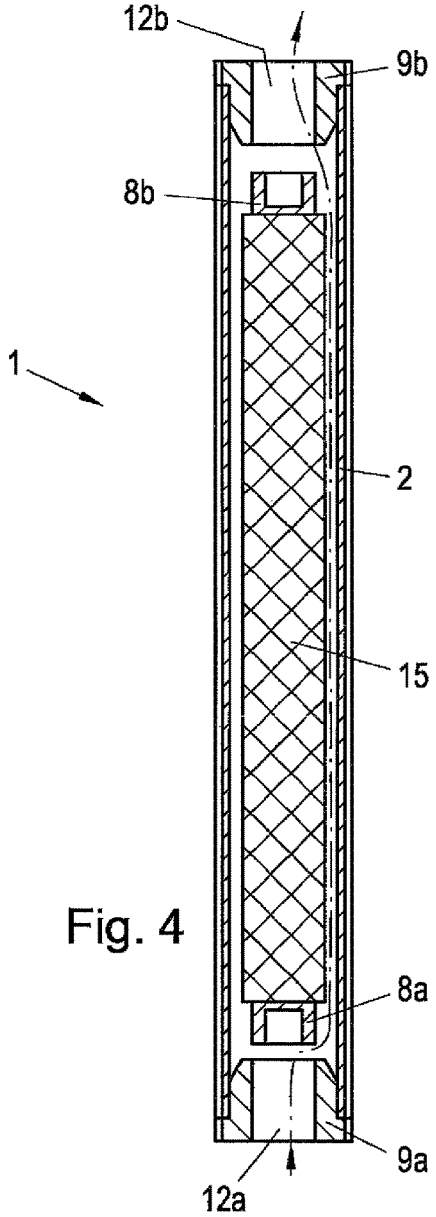
FIG. 4 shows a dispenser cartridge and a sectional view in an open operating configuration.

FIG. 4 shows the dispenser cartridge 1 in an open operating configuration. Here a flow passage for the liquid through the central space 3 exists, bypassing the dispenser element 15. This flow passage is released by adjustment of the closure means 4*a*, 4*b*, wherein in FIG. 4 the two plugs 8*a*, 8*b* are moved toward the interior of the central space 3 and are no longer seated in the guide elements 9*a*, 9*b*. This allows liquid to enter through the central recesses 12, 12*b* into the interior of the central space 3 and exit therefrom again.

Figure 2:
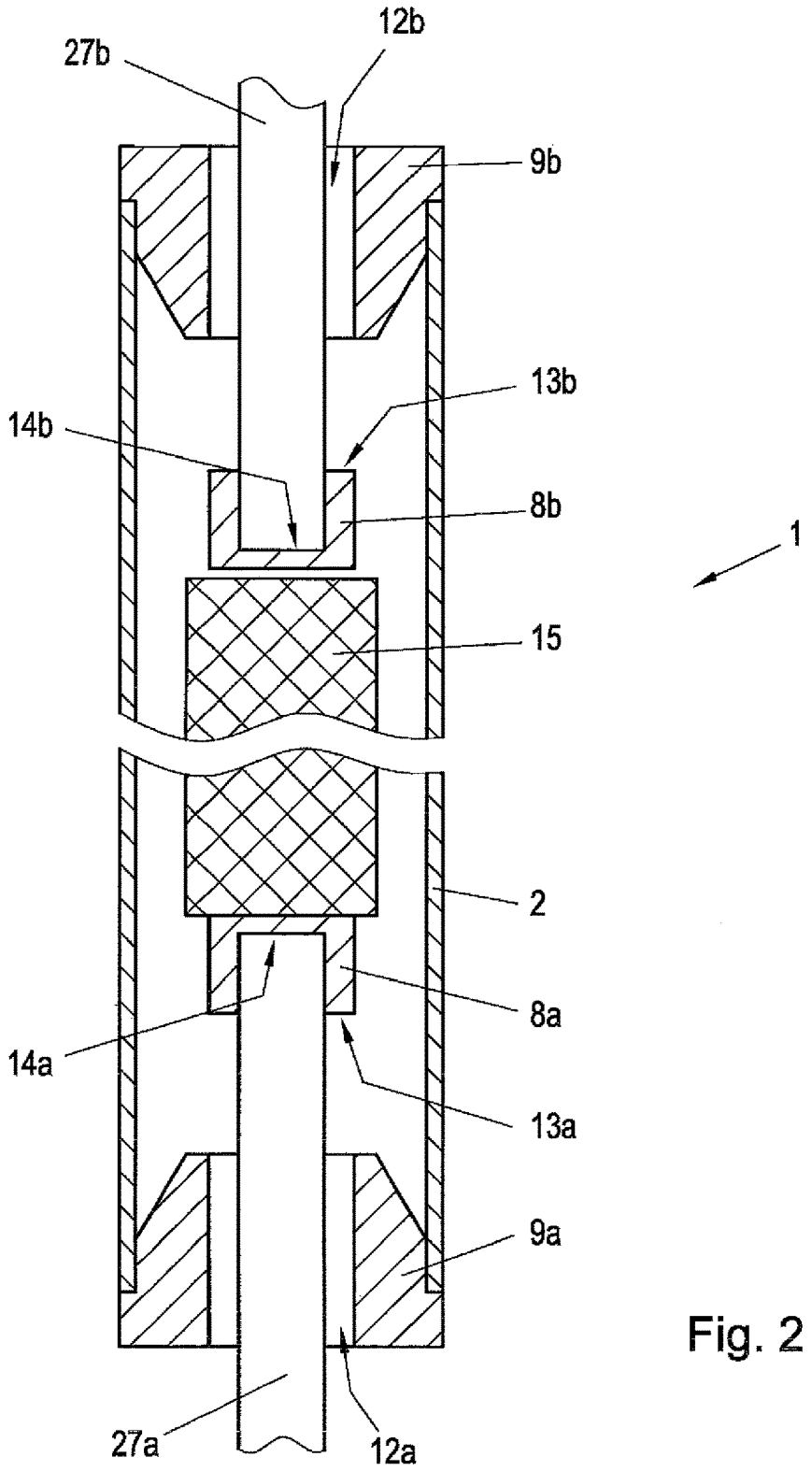
FIG. 2 shows a longitudinal section through a dispenser cartridge.

The closure means 4*a*, 4*b* in the present case, more specifically the plugs 8*a*, 8*b* are, as shown in FIG. 2, adjustable via externally actuatable activating or actuating means 27*a*, 27*b*. First the actuating means 27*a*, 27*b* engage in actuating guides 14*a*, 14*b* formed on the respective outsides 13*a*, 13*b* of the plugs 8*a*, 8*b* and in this way displace the plugs 8*a*, 8*b* along the central longitudinal axis 5 linearly into the central space 3. Ideally, the actuating means are insertable force-fittingly and/or form-fittingly, i.e., clearance-free with friction fit into the actuating guides 14*a*, 14*b*, so that also a movement in opposite direction is possible and the plugs 8*a*, 8*b* can be pulled outwardly again. In this way the flow passage through the central space 3 is reduced again or the openings 11*a*, 11*b* or the central recesses 12*a*, 12*b* are at least partially or even entirely closed.

The dispenser cartridge 1 is constructively and also functionally configured to be inserted and used in a corresponding dispenser arrangement 20. Such a dispenser arrangement 20 includes a dispenser attachment 21, which is or can be connected with a liquid source or a container for receiving and storing liquids, for example a bottle or the like. The dispenser arrangement 20 also includes the dispenser cartridge 1, which is operably arranged in or on the dispenser attachment 21 or can be operatively connected with the dispenser attachment 21, so that the liquid, which flows through the dispenser attachment 21, can take up the dispenser substance from the dispenser cartridge 1.

The following FIGS. 8 to 15 show a particularly advantageous but not limiting exemplary embodiment of a dispenser arrangement 20 according to the invention for introducing a dispenser substance into a liquid. The dispenser arrangement 20 includes dispenser attachment 21 through which liquid from a container or a liquid source can flow, wherein the liquid can be brought to a dispenser opening 23. In, this way the liquid or the mixture reaches the user or consumer.

The dispenser arrangement 20 also contains a dispenser cartridge 1 inserted into the dispenser arrangement 20, which dispenser cartridge is essentially constructed as shown in FIGS. 1 to 7, and which can be operated with the dispenser attachment 21 and is functionally connected with the dispenser attachment 21. In the dispenser arrangement 20 a defined main flow passage 24 for the liquid is formed, which extends from the source in the direction toward the dispenser opening 23 by avoiding the dispenser cartridge 1 or by bypassing the dispenser cartridge 1. In addition a defined bypass passage 25 is formed, which is fluidly completely separated from the main flow passage 24 and which extends through the dispenser cartridge 11 also from the liquid source in the direction to the dispenser opening 23, so as to contact the dispenser element 15 and to take up at least a portion of the dispenser substance.

The predominant portion of the liquid flows via the main flow passage 24, i.e., more than 50%. The amount, however, can be adjusted and depends inter alia on the dispenser substance to be added and the desired concentration. It is possible without problems to increase the ratio of the liquid amounts of the main flow passage to the bypass passage 24 for example to at least 5:1 or 9:1.

Figure 8:
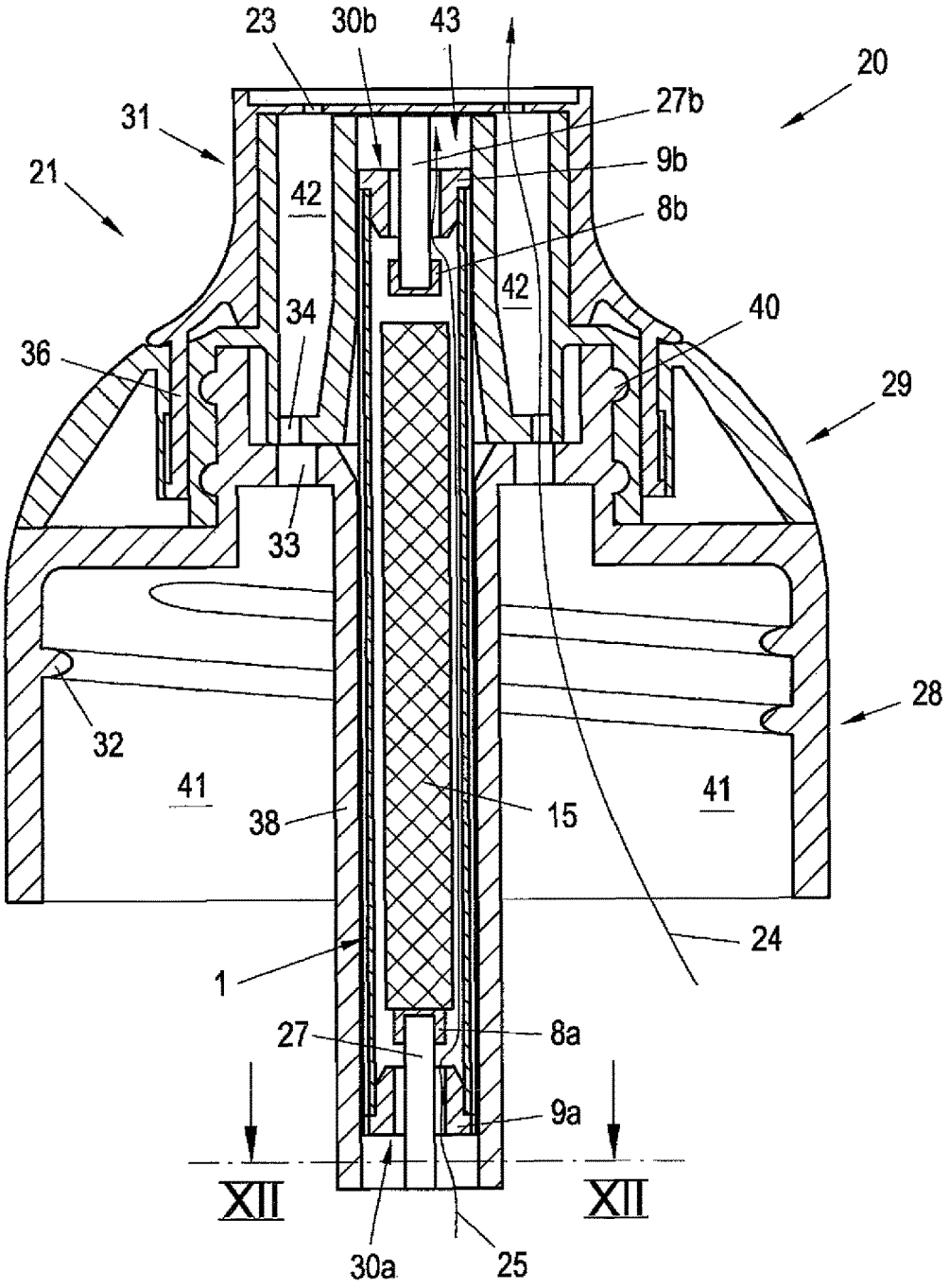
FIG. 8 shows a dispenser arrangement according to the invention in a closed position in a sectional view.

FIG. 8 shows a particularly advantageous embodiment of the dispenser arrangement 20. The dispenser cartridge 1 corresponds to the dispenser cartridge of FIGS. 1 to 4. The dispenser attachment 21 includes a base unit 28, and activating unit 29 and a closure unit 31 as basic components.

Figure 12:
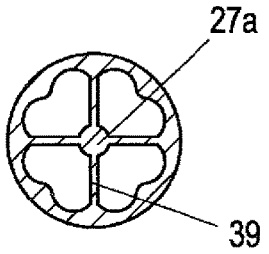
FIG. 12 shows the section XII through the dispenser arrangement.

The base unit 28 has an inner threading 32, with which the dispenser attachment 21 can be screwed onto a bottle. The base unit 28 also includes a first seat 30*a* for the dispenser cartridge 1. This seat 30*a* includes a hollow cylindrical part 38, which extends downward along the longitudinal axis 5 toward the liquid source. The inner surface of the first sea 30*a* or the hollow cylindrical part 38 is configured mirror symmetrically or corresponding to the outer shape of the sleeve element 2 (FIG. 12). The dispenser cartridge 1 is thereby protected against rotation in the base unit 28 or in the first seat 30*a* or in the hollow cylindrical part 38. In the lowermost end region the grid element 39 (FIG. 12) is provided, which has a central upwardly oriented bolt 27*a*. This bolt 27*a* functions as a first activating or actuating means 27*a* and engages into the actuating guide 14*a* of the plug 8*a* of the dispenser cartridge 1.

Figure 11:
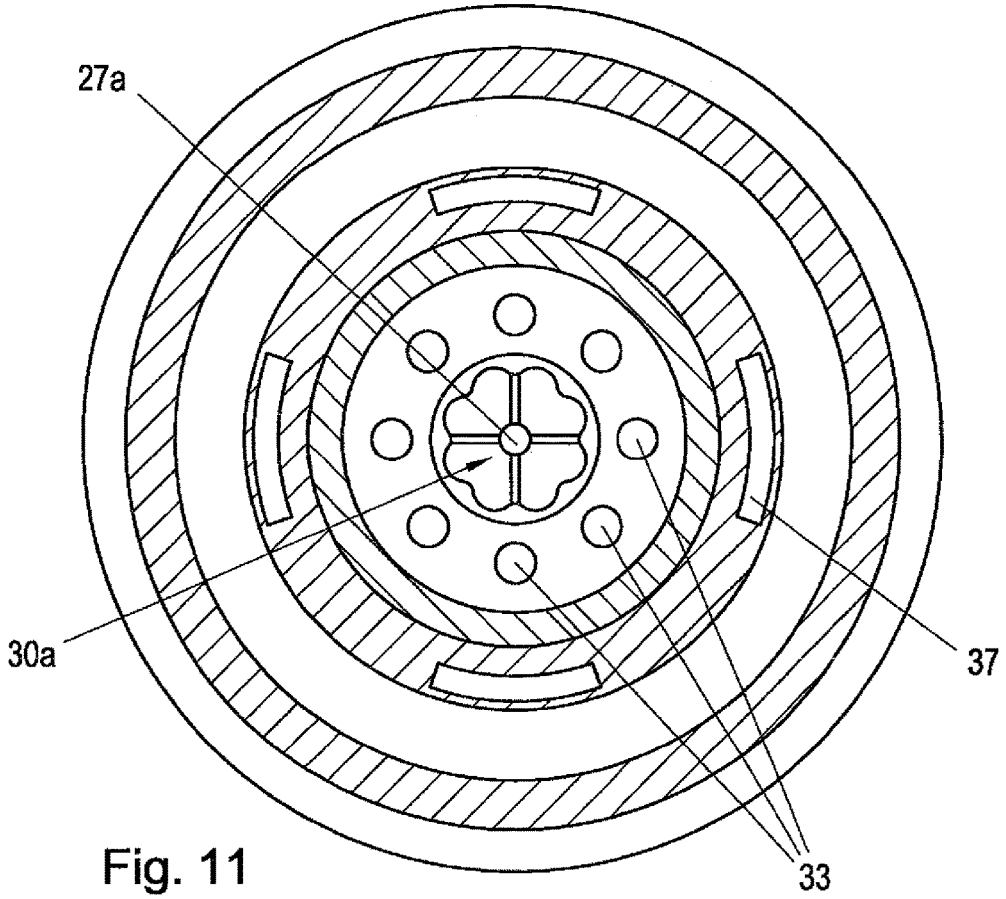
FIG. 11 shows the section XI through the dispenser arrangement.

In the upper region of the base unit 28 a number of passage openings 33 are provided, which are arranged circularly about the dispenser cartridge 1. This can also be seen in detail in FIG. 11, which shows a view taken along the sectional line XI from the activating unit 29 in the direction of the base unit 28. The annularly arranged passage openings 33 can be seen as viewed downward onto the first bolt 27*a*. In FIG. 11 the dispenser cartridge 1 is not shown for clarity reasons.

Figure 13:
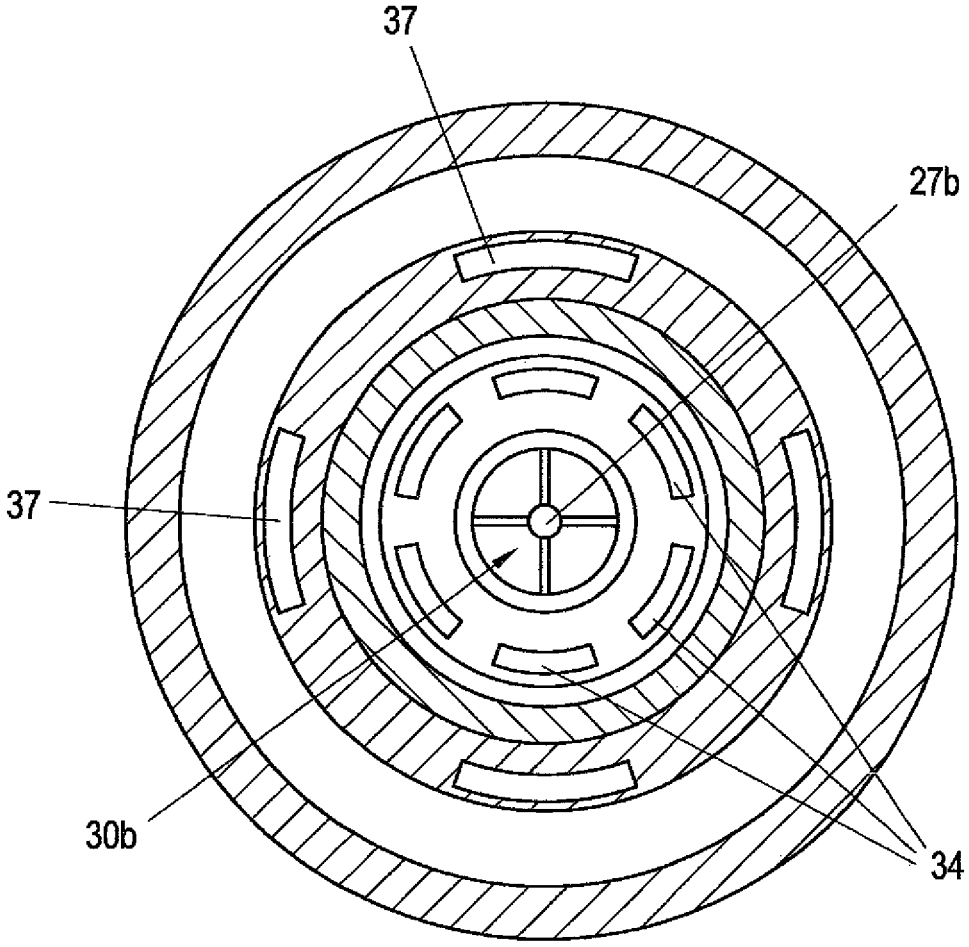
FIG. 13 shows the section XIII through the dispenser arrangement.
Figure 14:
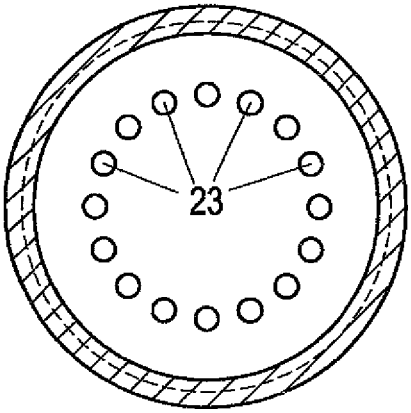
FIG. 14 shows the section XIV through the dispenser arrangement.

FIG. 12 Shows a view taken along the sectional line XII through the grid element 39, which carries and supports the first bolt 27*a* in its center. The activating unit 29 adjoins the base unit 28 upwardly and can be adjusted relative to the base unit 28 or respectively is supported rotatably via a threading 40. In this way the distance between the base unit 28 and the activating unit 29 can be changed. The activating unit 29 includes as an essential element a second seat 30*b* for the opposite end of the dispenser cartridge 1. Also in this case a grid element, in particular identical to the first grid element 39, is provided which carries a second bolt 27*b*, which is oriented downwardly in the direction of the base unit 28. The inner surface of the second seat 30*b* is configured circular cylindrical (FIG. 13). As a result the dispenser cartridge 1 can rotate in or respectively relative to the second seat 30*b*. The activating unit 29, like the base unit 28, is configured so that the liquid can fully flow through it. Thus the liquid can enter at the bottom through inflow openings 34. This is shown in detail in FIG. 13, which represents a view taken the along the sectional line XIII, in the direction from the base unit 28 to the activating unit 29. The slot-shaped inflow openings 34 can be seen, which are arranged about the not shown dispenser cartridge 1, and the centrally arranged bolt 27*b*. During operation the dispenser cartridge 1 is thus seated in the first seat 30*a*, as well as in the second seat 30*b* and is held and surrounded from all sides by the base unit 28 and activating unit 29.

As further components the dispenser arrangement also includes the closure unit 31. The closure unit serves for closing the bypass passage 25 and optionally also the main flow passage 24. In the closure unit 31 the dispensing openings 23 are formed. These are shown in more detail in FIG. 14, in which a section according to the sectional line XIV from the bottom this shown. The closure unit 31 can be linearly moved up and down via a number of webs 36, which are displaceably supported in guides 37 of the activating unit 29, and in this way are suited for closing the flow passageways.

Figure 15:
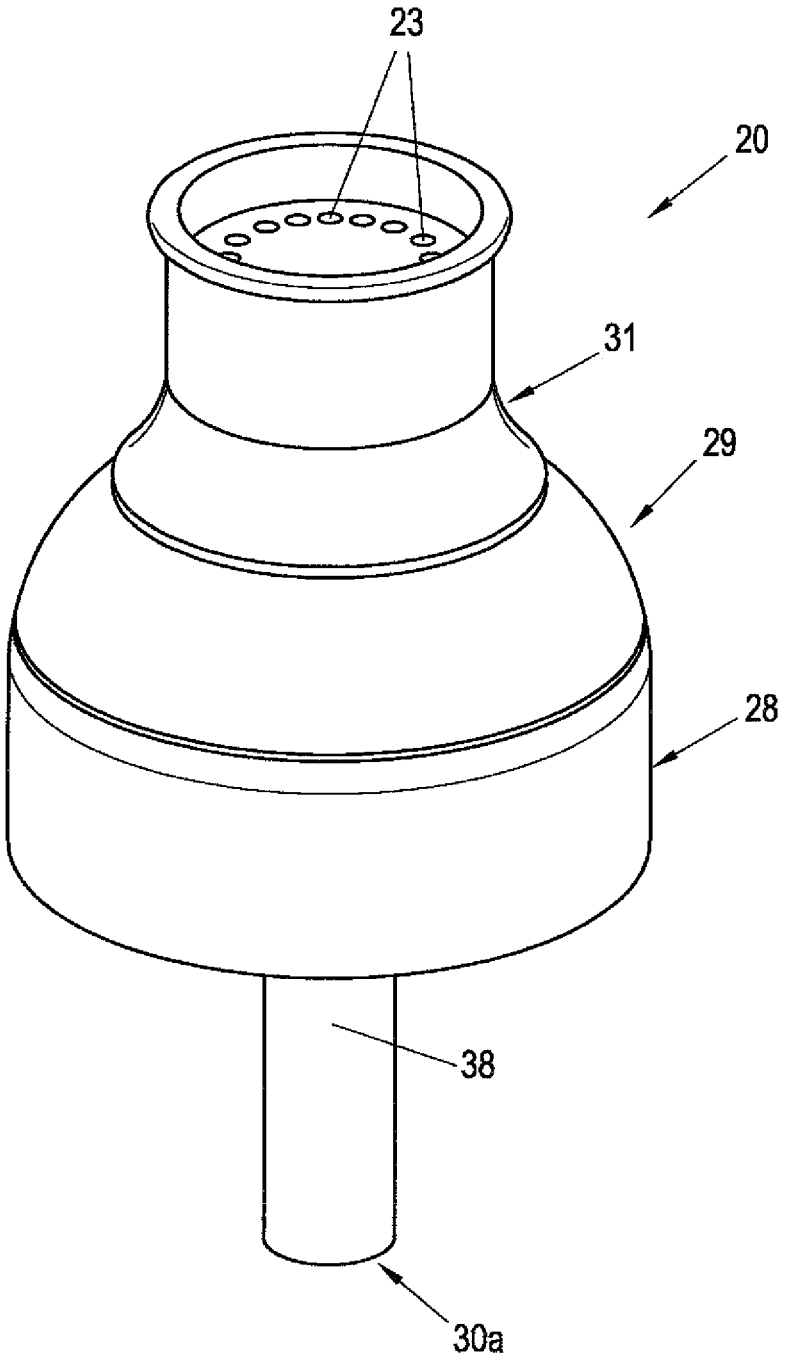
FIG. 15 shows a perspective representation of the entire dispenser arrangement.

FIG. 15 shows the individual elements in the assembled state. At the bottom, the outside of the first seat 30*a* including the hollow cylindrical part 38 can be seen, which represents the lower part of the base unit 28. Adjoining at the top is the activating unit 29 and adjoining the activating the 29th the closure unit 31 with the dispensing openings 23. In order to enable easy drinking, the diameters of the components narrow from the base unit 28 via the activating unit 29 to the closure unit 31, wherein the diameter of the uppermost region of the closure unit 31 corresponds to the diameter of a conventional mouthpiece of a drinking bottle.

FIG. 8 shows a cross-section through a particularly advantageous embodiment of the dispenser arrangement 20, i.e., in a position in which the dispenser cartridge 1 is already activated and opened, but the closure unit 31 is still closed. The reference numeral 24 indicates the main flow passage, which initially can freely traverse a space 41 of the base unit 28, exits the base unit 28 through the flow-through passages 33, enters the activating unit 29 through the inflow openings 34, and flows form the activating unit through the space 42 upwards and leaves the dispenser arrangement 20 through the outlet openings 23. In the present embodiment, the outlet openings 23 are not closable by the closure unit 31, but are rather permanently open. In this way the pure liquid from the source can thus permanently flows through and exit from the dispenser arrangement 20. However, it would also be easily possible to configure the dispenser arrangement 20 so that the closure unit 31 also blocks the main flow passage 24, for example by arranging the dispensing openings 23 further inwardly, whereby the web of the activating unit 29 closes the dispensing openings 23. The reference numeral 25 indicates the bypass passage extending through the dispenser cartridge 1. The liquid takes up the dispenser substance and exits from the central recess 12*b* out of the dispenser cartridge 1 and enters an annular space 43, which is divided into regions by the grid element 39. This annular space 43 however is closed by the closure unit 31, whereby the liquid can pass through the dispenser cartridge 1, however, it cannot leave the dispenser 20 and cannot connect with the main flow passage 24. In this position thus only pure liquid reaches the consumer.

Figure 9:
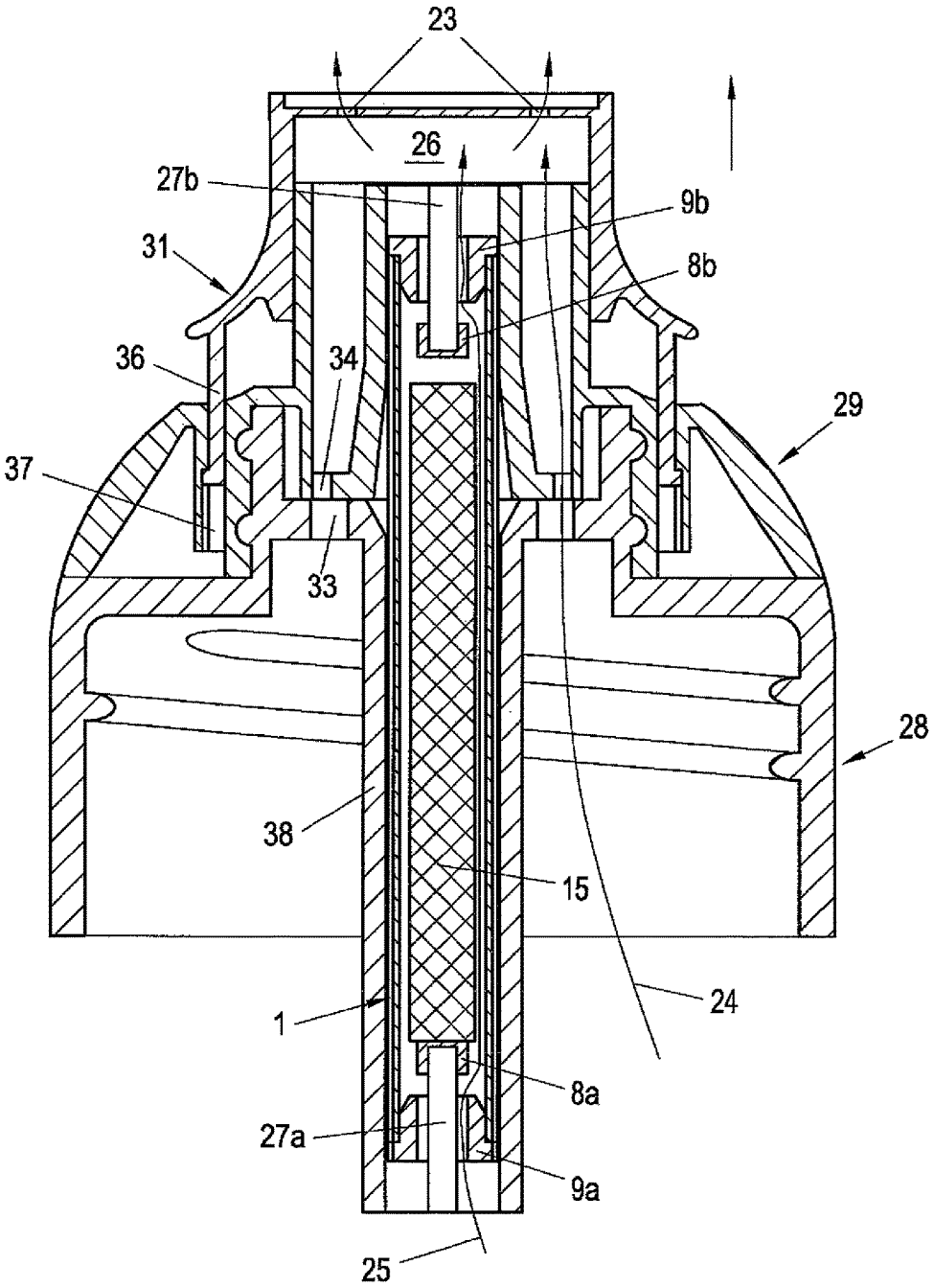
FIG. 9 shows the dispenser arrangement in an open position and a sectional view.

FIG. 9 shows the dispenser arrangement 20 in a position in which the closure unit 31 is opened. The flow passages of the bypass passage 25 and the main flow passage 24 through the dispenser arrangement 20 are initially not changed. However, as a result of the upward displacement of the closure unit 31 relative to the activating unit 29, a mixing chamber 26 is formed, which is positioned downstream of the dispensing openings 23 upstream of the outlet end regions of the main flow passage 24 and the bypass passage 25. The main flow passage 24 hereby leads from the annular space 43 into the mixing chamber 26 where it can be distributed. Also the bypass passage 25 leads from the annular space 43 into the mixing chamber where it can be distributed. In the mixing chamber 26 the two streams mix and the pure liquid is mixed with the liquid that was containing the dispenser substance. The thus mixed streams can then exit the mixing chamber 26 via the dispensing opening 23.

FIGS. 8 and 9 respectively show the dispenser cartridge 1 in a maximally opened position, in which the flow passage through the dispenser arrangement 1 is maximally opened, i.e., the plugs 8*a*, 8*b* are maximally displaced inwardly into the central space 3. In this way the greatest possible amount of dispenser substance is taken up into the liquid.

Figure 10:
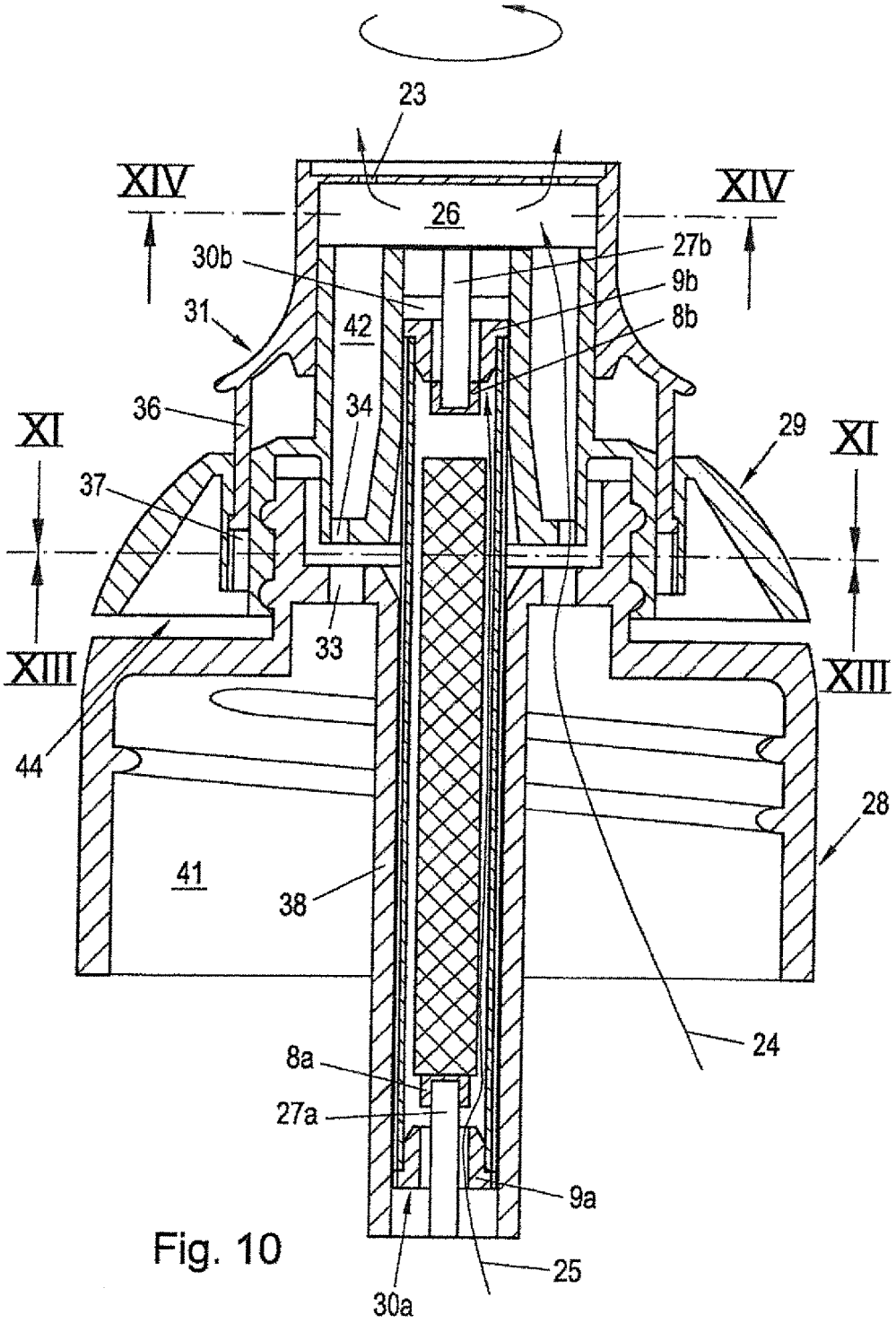
FIG. 10 shows the dispenser arrangement in adjusted, open position in a sectional view.

FIG. 10 shows a position of the dispenser arrangement 20 in which the mixing chamber 26 is formed, i.e., the closure unit 31 is opened, however, in which the flow passage through the dispenser cartridge 1 is decreased. This is caused by rotation of the activating unit 29 relative to the base unit 28 (indicated by the arrow), whereby a gap region 44 is formed between these units. As a result, the linear distance between these two bolts 27*a*, 27*b* increases. Due to the fact that the bolt 27*b* engages in the plug 8*b* with friction fit and clearance-free, the bolt 27*b* caries the plug 8*b* along upwardly when the activating unit 29 is displaced upwardly. In this way the plug 8*b* decreases the central recess 12*b* and with this reduces the amount of liquid exiting from the dispenser cartridge 1. In FIG. 10 the exiting is almost entirely prevented because the plug 8*b* already almost sealingly contacts the central recess 12*b*. A complete closure is possible, however, in practice the flow amount is reduced by at least 50%, in particular cases at least 70% or at least 90%, compared to the maximally possible flow amount at full opening, i.e., a certain residual flow always remains and a slight amount of liquid enriched with dispenser substance always flows through the dispenser cartridge 1 in the direction of the annular space 43 or the mixing chamber 26. In FIG. 10 the bypass passage is therefore closed to the most degree and only a very small amount of dispenser substance reaches the mixing chamber 26 and subsequently the dispenser openings 23. As a result of rotating the activating unit 29 as indicated by the arrow in FIG. 10, relative to the base unit 28 and the associated linear increase or decrease of the distance between the bolts 27*a*, 27*b*, the content of dispenser substance in the liquid that exits the dispenser arrangement, 20 can be adjusted or regulated within wide ranges.

As an alternative to the above-mentioned embodiment, the inner circumference of the hollow cylindrical part 38 in the base unit 28 can have an inner smooth circular cylindrical cross section. The dispenser cartridge 1 can hereby be secured against rotation by configuring the inner circumference of the second seat 30*b* mirror inverted or corresponding to the outer shape of the sleeve element 2. As an alternative also the inner circumference of the second seat 30*b* can have an internally smooth circular cylindrical cross section so that the dispenser cartridge 1 can rotate about its longitudinal axis in the first seat 30*a* as well as in the second seat 30*b*.

By way of a preferred exemplary embodiment the functional principle or the practical use of the dispenser cartridge 20 is explained below:

In the present example a dispenser arrangement 20 is described which is configured as a bottle attachment, which can be screwed onto a drinking bottle, which is filled with water or mineral water.

First the base unit 28 is attached with the threading 32 to the outer threading of the bottle. The first seat 30*a* hereby extends into the interior of the bottle, wherein the seat 30*a* is situated above the liquid level. This prevents the dispenser substance from entering the liquid.

In a next step a closed dispenser cartridge 1 is inserted into the base unit 28. In the present case a flavor agent is used as dispenser substance. The insertion and the secure fit are facilitated in that the dispenser cartridge 1 as well as the corresponding recess or the first seat 30*a* have a corresponding waved shape. In this way the dispenser cartridge 1 is also secured against rotation.

In a further step the activating unit 29 is attached to the base unit 28 and screwed downward by rotation via the threading 40. This reduces the distance between the bolts 27*a* and 27*b* and both plugs 8*a* and 8*b* are pushed inwards by a perceptible clicking. The dispenser cartridge 1 is thus activated and has assumed the open operating configuration in which a flow passage is established through the dispenser cartridge 1.

In a next step the closure unit 31 is opened by lifting the closure unit relative to the activating unit 29, whereby the chamber 26 is formed and all flow passages are open.

When the bottle is now tilted, the water flows out of the bottle through the main flow passage 24 into the mixing chamber 26 and also through the bypass passage 25 through the dispenser cartridge 1 into the mixing chamber 26. In this position the bypass flow 25 entrains the maximal amount of flavor agent, and water enriched with flavor agent can be withdrawn from the dispensing openings 23.

When the amount of flavor agent is to be reduced, the activating unit 29 is rotated upward relative to the base unit 28, which reduces the bypass flow 25 as shown in FIG. 10 and the amount of flavor agent is reduced.

When desiring to drink pure water, the bypass passage 25 can be fully closed by closing the closure unit 31.

The invention claimed is:

1. A dispenser arrangement for introducing a dispenser substance into a liquid, comprising:

a dispenser attachment having at least one dispensing opening and being constructed for connection with a liquid source or a container for receiving and storing a liquid, said dispenser attachment being configured to allow flow of at least a portion of the liquid through the dispenser attachment and to the at least one dispensing opening; and a dispenser cartridge, said dispenser cartridge containing a dispenser substance, wherein the dispenser cartridge is operably arranged in or on the dispenser attachment or is operatively connectable with the dispenser attachment, wherein a defined main flow passage for flow of the liquid therethrough is formable in the dispenser arrangement, said flow passage extending in a direction toward the dispensing opening so as to bypass the dispenser cartridge, and wherein a defined bypass passage is formable, which is fluidly separated from the main flow passage, and extends through the dispenser cartridge in the direction toward the dispenser opening so as to contact and take up a portion of the dispenser substance, wherein the dispenser cartridge is reversibly exchangeably insertable into the dispenser arrangement.

2. The dispenser arrangement of claim 1, wherein a predominant portion of the liquid flows via the main flow passage or wherein a ratio between an amount of liquid that flows through the main flow passage and an amount of liquid that flows through the bypass passage is at least 1:1.

3. The dispenser arrangement of claim 1, wherein the main flow passage and the bypass passage are fluidly connectable to each other or meet before the dispensing opening, and wherein a proportion of the liquid flowing in the main flow passage is united and mixed with a proportion of the liquid flowing in the bypass passage.

4. The dispenser arrangement of claim 1, wherein a mixing chamber is formable in the dispenser attachment, said mixing chamber being arranged between the dispensing opening and the dispenser cartridge, said mixing chamber being fluidly connected with the main flow passage and the bypass passage.

5. The dispenser arrangement of claim 1, wherein the main flow passage surrounds at least a portion of the bypass passage, the main flow passage being configured in the form of multiple separate channels or in the form of an essentially ring-shaped channel.

6. The dispenser arrangement of claim 1, wherein the dispenser attachment comprises activating or actuating means for actuating a closure means, so as to open the dispenser cartridge and/or adjust an amount of the liquid flowing through the bypass passage.

7. The dispenser arrangement of claim 6, wherein the dispenser attachment includes a base unit and an activating unit adjustable relative to the base unit, wherein the activating or actuating means are provided in the base unit and in the activating unit for acting on the closure means and for opening the dispenser cartridge thereby opening the bypass passage.

8. The dispenser arrangement of claim 7, wherein in the base unit a first seat for a first end of the dispenser cartridge is formed, wherein at a side of the seat, which is distal to the dispensing opening, a first one of the activating or actuating means is arranged for opening a first one of the closure means.

9. The dispenser arrangement of claim 8, wherein in the activating unit a second seat for another end opposite the first end of the dispenser cartridge is formed, wherein at a side of the second seat, which is proximate to the dispensing opening, a second one of the activating or actuating means is arranged for opening a second one of the closure means.

10. The dispenser arrangement of claim 9, wherein the base unit and the activating unit are supported for adjustment of a distance between each other, whereby a linear distance of the first activating or actuating means to the second activating or actuating means is adjustable, and wherein a decrease of the distance causes the closure means being pushed into the interior of the dispenser cartridge.

11. The dispenser arrangement of claim 6, wherein the closure means are movable or displaceable toward each other by a same respective distance.

12. The dispenser arrangement of claim 7, wherein in the base unit a first seat for a first end of the dispenser cartridge is formed, wherein at a side of the seat, which is distal to the dispensing opening, a first one of the activating or actuating means is arranged for opening a first one of the closure means, wherein in the activating unit a second seat for another end opposite the first end of the dispenser cartridge is formed, wherein at a side of the second seat, which is proximate to the dispensing opening, a second one of the activating or actuating means is arranged for opening a second one of the closure means, and wherein the activating or actuating means are dimensioned so that they force and/or form fittingly engage into the closure means.

13. The dispenser arrangement of claim 12, wherein an increase of the linear distance between the first activating or actuating means and the second activating or actuating means results in a movement of the closure means in a direction of an original position of the closure means in a flow through capacity which is reduced by at least 50% relative to a maximal flow through capacity of the dispenser cartridge.

14. The dispenser arrangement of claim 7, further comprising a stop for limiting a maximal displacement of the base unit relative to the activating unit.

15. The dispenser arrangement according to claim 7, wherein the dispenser attachment has a threading and is screwable onto a bottle.

16. The dispenser arrangement according to claim 7, further comprising a closure unit which is supported for adjustment relative to the activating unit, and configured for closing the bypass passage and optionally the main flow passage.

17. The dispenser arrangement according to claim 16, wherein a mixing chamber is formed when the closure unit is lifted from the activating unit.

* * * * *